United States Patent [19]

Orr et al.

[11] 4,154,267

[45] May 15, 1979

[54] HAND LOOM

[76] Inventors: Robert P. Orr; Joan B. Orr; Thomas P. Orr, all of 104 Main St., Tiburon, Calif. 94920

[21] Appl. No.: 884,165

[22] Filed: Mar. 7, 1978

[51] Int. Cl.[2] ..... D03D 29/00

[52] U.S. Cl. ..... 139/29; 28/191

[58] Field of Search ..... 139/29, 33; 28/149, 28/151, 152, 191, 192

[56] References Cited

U.S. PATENT DOCUMENTS

| | | | |
|---|---|---|---|
| 396,281 | 1/1889 | Kynett | 139/29 |
| 882,019 | 3/1908 | Reed | 139/29 |
| 1,332,165 | 2/1920 | Neergaard | 139/33 |
| 1,904,715 | 4/1933 | Bergman et al. | 139/29 |
| 2,094,505 | 9/1937 | Thackeray | 139/33 |
| 2,468,880 | 5/1949 | Johnson et al. | 139/29 |
| 2,985,198 | 5/1961 | Paternayan | 139/33 |
| 3,867,965 | 2/1975 | Hanson | 139/29 |

*Primary Examiner*—Henry Jaudon
*Attorney, Agent, or Firm*—Owen, Wickersham & Erickson

[57] ABSTRACT

A weaving loom. A mid-beam subassembly includes a pair of horizontal supports, one secured to each of a spaced-apart pair of uprights, and supporting between them a cloth beam and a sectional warp beam. Both beams have, at one end, a handle and a ratchet wheel engageable by a pawl pivotally mounted to a support. The warp beam has a series of rails carrying section-defining dowels. A top-beam subassembly comprises a pair of horizontal supports, one secured to each pair of uprights, each having a forward portion longer than its back portion. A stationary cylindrical breast beam joins the forward portions, and a stationary cylindrical back beam joins the back portions. A pair of upright stanchions have three vertically spaced apart notches apiece. A server rail joins the lower ends of the stanchions, and an accessory bar joins the stanchions near their upper ends. A server slides on the server rail and has an outwardly projecting and turned-up arm having a series of through openings receiving separately all the warp threads for one section of the warp beam. Warp rods are mountable across the stanchion notches. At other times, a beater reed is hangable by each pair of stanchion notches.

28 Claims, 28 Drawing Figures

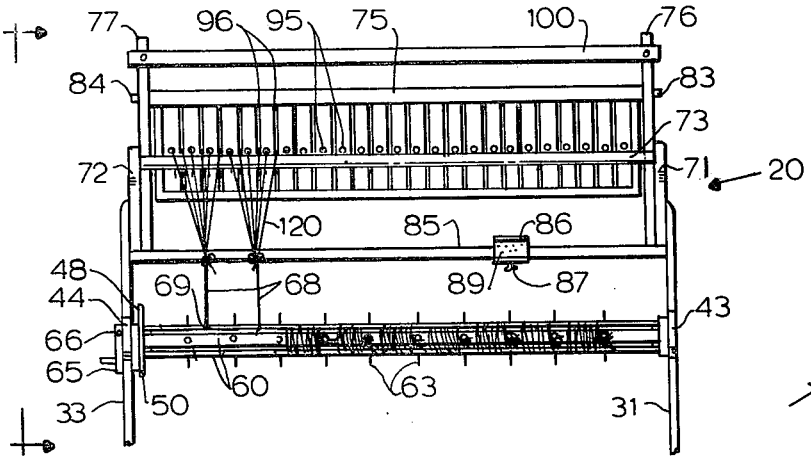
FIG. 8
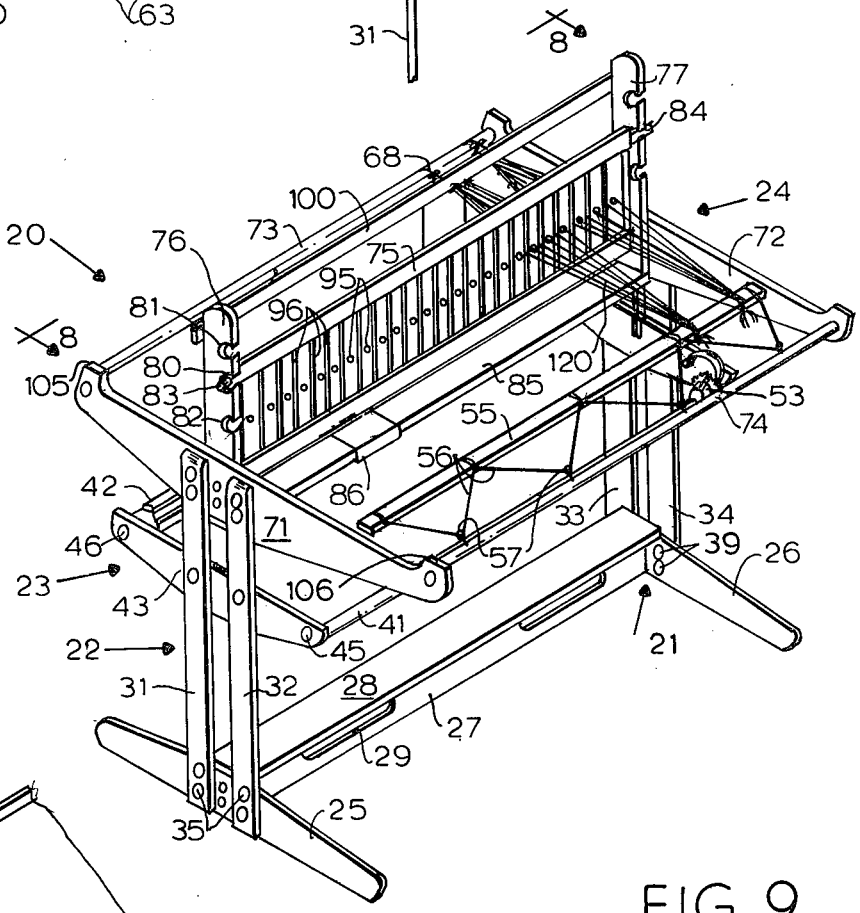
FIG. 7
FIG. 10
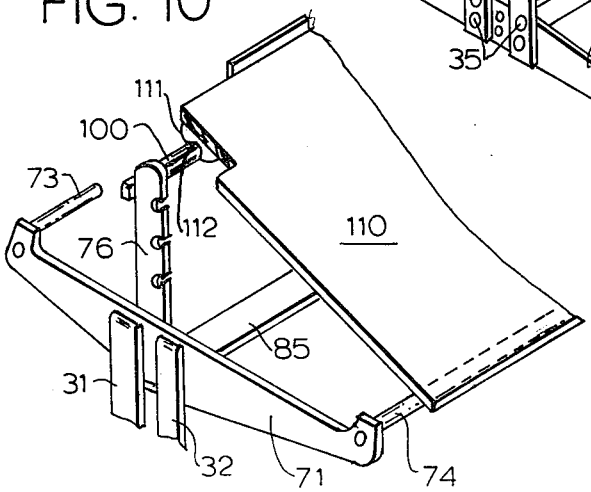
FIG. 9
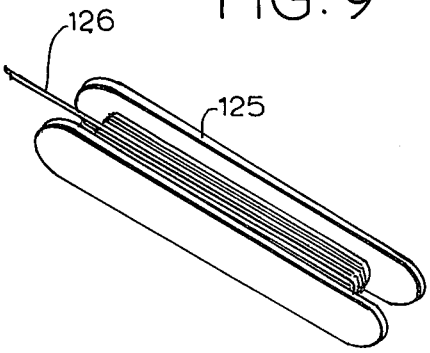

FIG. 11
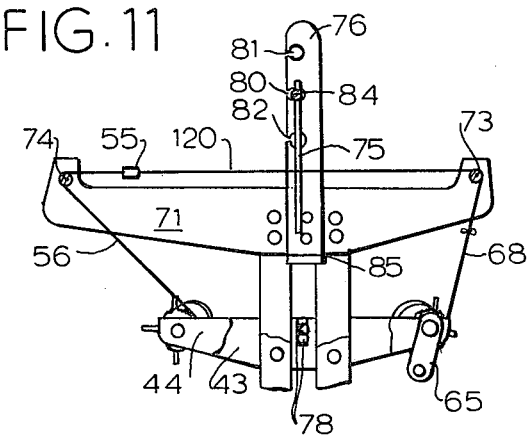
FIG. 13
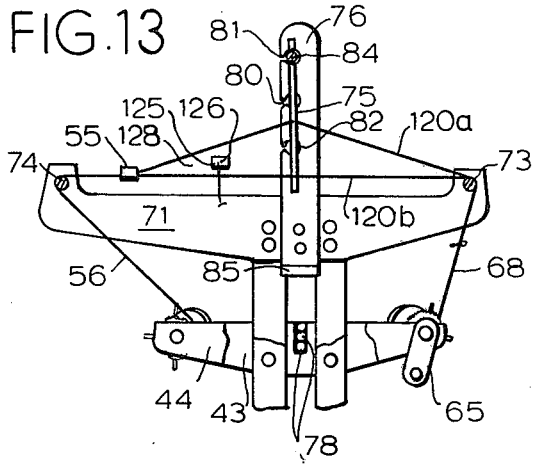
FIG. 12
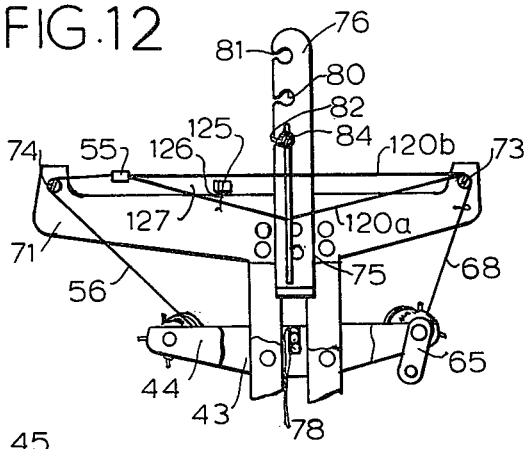
FIG. 14
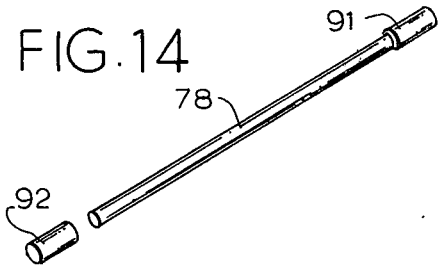
FIG. 17
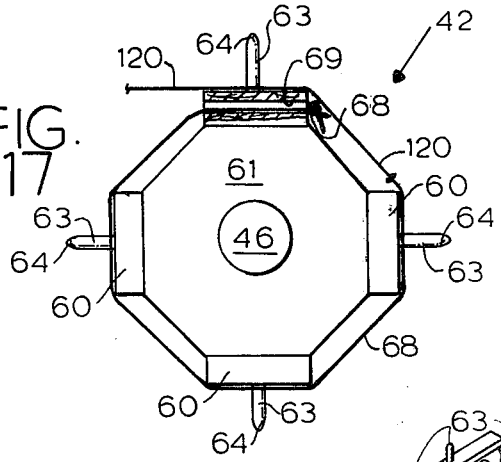
FIG. 15
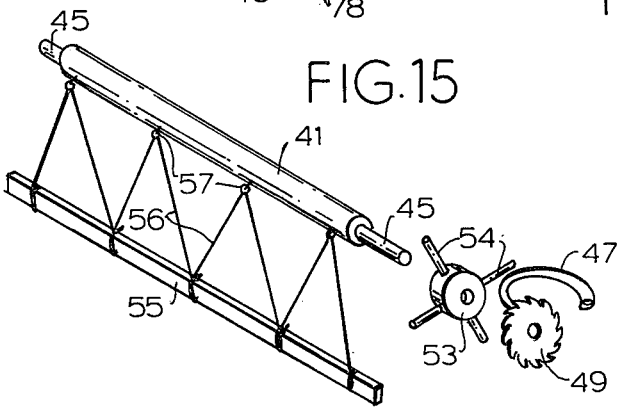
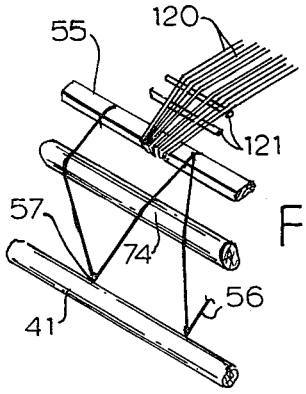
FIG. 16
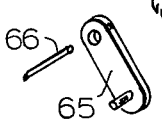
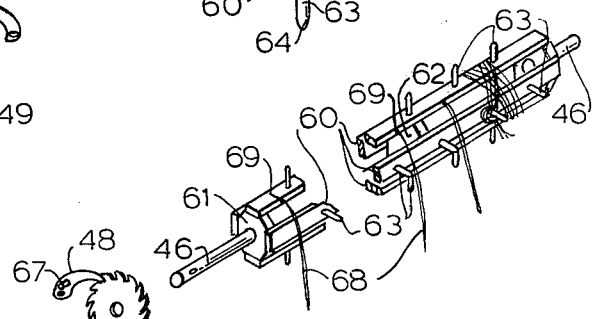
FIG. 18

FIG. 19
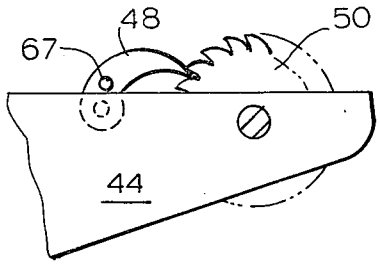
FIG. 20
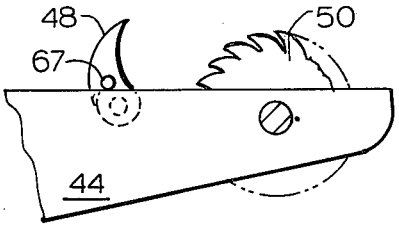
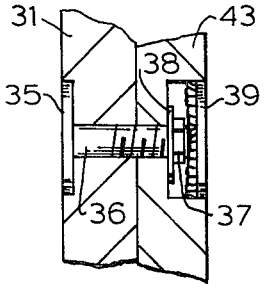
FIG. 22
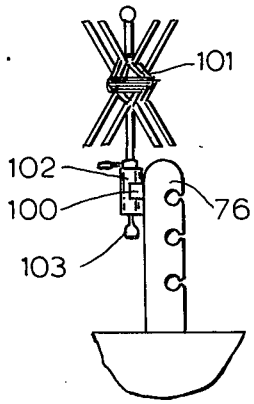
FIG. 21
FIG. 23
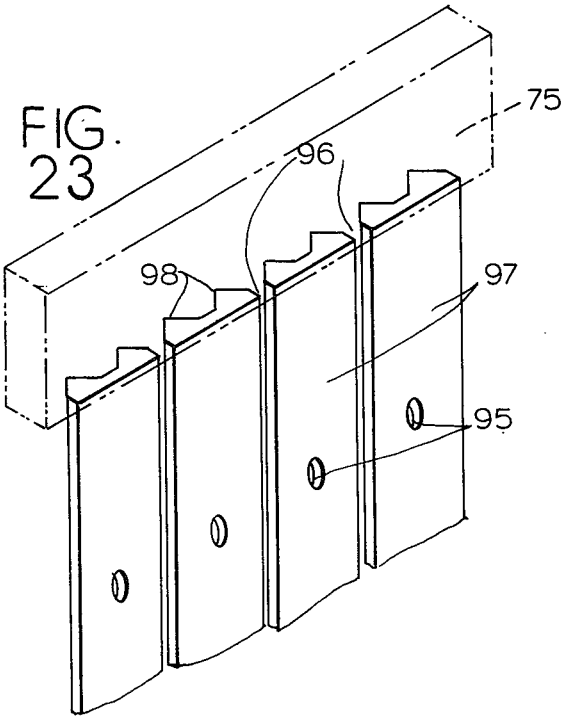
FIG. 24
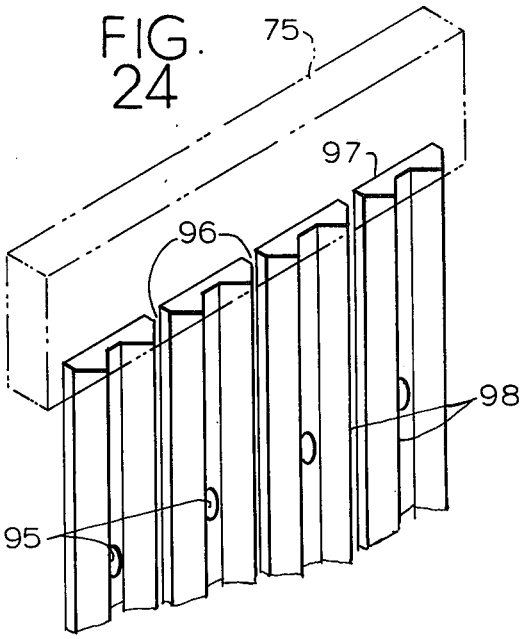

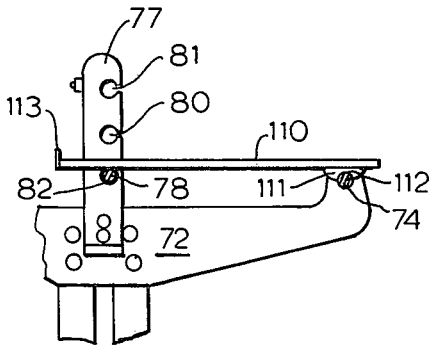
FIG. 25
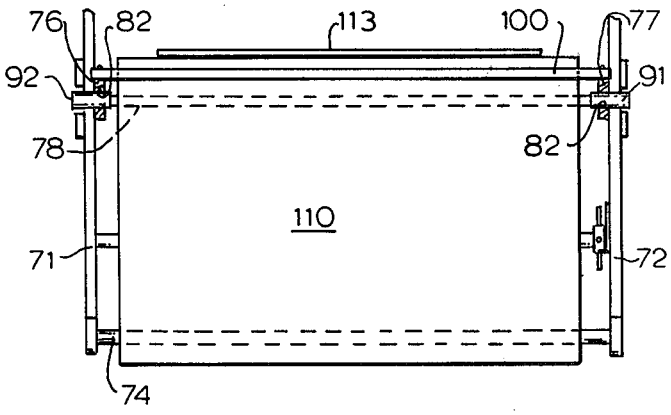
FIG. 26
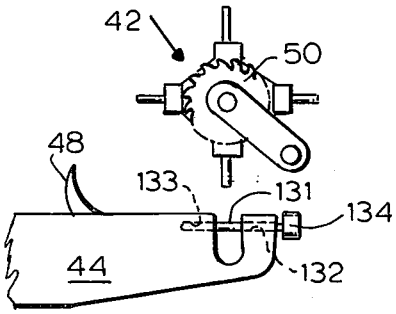
FIG. 27
FIG. 28
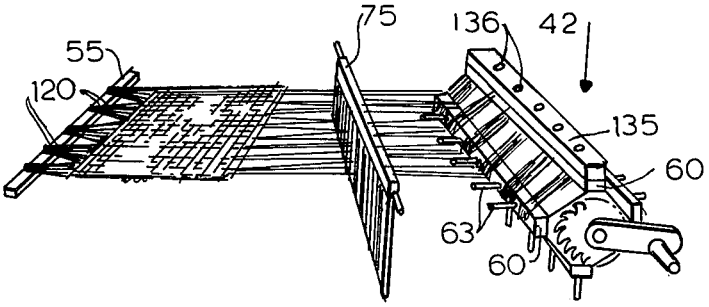

HAND LOOM

BACKGROUND OF THE INVENTION

This invention relates to an improved loom for artistic or craft weaving, for home or studio use, as distinct from the mechanical looms of factories.

One of the problems with this type of a loom is the difficulty in warping the loom, that is, applying the warp threads before weaving. This is hard work and time-consuming. It has usually involved the use of a warping rack holding a number of spools. Each warp thread has been wound from the spools on to and around a warp beam. This type of installation has tended to result in cross-overs and twists, and as a result the warp thread has later come off the warp beam somewhat unevenly and at various tensions, and has caused trouble with the shedding action during weaving, because some of the warp threads are then not coplanar with the others. Heretofore, the normal solution to the problem has required the weaver to purchase a tension box, spool rack, a yardage counter, and a raddle; the present invention enables the elimination of all those elements.

Another difficulty in setting up the warp has been the threading of the beater reed itself, which has been always upright in most looms and has therefore required the weaver to work from an awkward position, often without being able to see well what is being done.

Another related problem is that of adjusting the tension of the warp threads evenly.

Another type of problem with looms has been that they often present a very small area visible easily to the weaver so that it is difficult to follow large designs. Looms large enough to enable the weaver to have before him a large area of woven cloth have been so large that they have been awkward to locate a place for, especially if used in an individual's home instead of a spacious studio. Thus, it has been a problem to construct a loom which is both large enough for working and small enough for ready storage and use in relatively small rooms.

Another problem has been that the beater reed on such a loom has usually been capable of only one type of beating action, and this has limited the variety of types of packing or beating that the loom could do. If one needed a different type of beating action, one would have had to have another completely separate beater reed.

In addition, typical looms have been relatively inefficient and have been unpleasing in appearance.

Thus, among the objects of the invention are those of providing a loom which is efficient, which has a good appearance, and which is relatively easy to warp, as well as to operate. Greatly increased efficiency of warping and of setting up the warp through the beater reed are other objects.

Another object of the invention is to provide a loom with a more versatile beater reed and to provide for easy alternation of the warp rods with the beater reed.

Another object of the invention is to provide improved pawl and ratchet systems on both the cloth beam and the sectional warp beam, so that both these beams become more efficient in their operation.

SUMMARY OF THE INVENTION

The loom of this invention comprises a spaced-apart pair of uprights on each side of the loom extending up from a supporting base and supporting a mid-beam subassembly and a top-beam subassembly.

The mid-beam subassembly includes a pair of generally horizontal support members, one secured to each pair of uprights, each having a fore portion and a rear portion. A cloth beam extends between and is rotatable relative to the fore portions, and a sectional warp beam extends between and is rotatable relative to the rear portions. The cloth beam has a tie-up bar connected to it by cord. The cloth beam also has a ratchet wheel at one end and a pawl pivotally mounted to a fore portion of the support member adjacent that end, for engagement with the ratchet wheel. The cloth beam also has handle means adjacent the ratchet wheel by which the cloth beam can be rotated. The sectional warp beam comprises a series of rails having section-defining dowels therealong to define sections thereon. A cord for each between-dowel section is anchored to and extends through one rail. The warp beam also has its own ratchet wheel at one end, and a pawl is pivoted to the rear portion of the support member adjacent the ratchet wheel for engagement therewith, as well as a handle means for rotating the warp beam.

The top-beam subassembly, comprises a pair of generally horizontal support members, one secured to each pair of uprights, each having a forward portion and a back portion, the forward portion being longer than said back portion to give more room for work where more is needed and to give a good overall view of large design areas. A stationary cylindrical breast beam extends across between the outboard ends of the forward portions, and a stationary cylindrical back beam extends across between the outboard ends of the back portions. A pair of identical upright stanchions extend up vertically, one from each support member of the top-beam subassembly; each stanchion has three vertically spaced-apart notches. A server rail joins the lower ends of the stanchions, and an accessory bar joins the stanchions near their upper ends.

One especially novel feature is a server slidably mounted along the server rail, with clamp means for holding it at any desired position. The server has an outwardly projecting arm with an angularly turned-up end. A series of openings extend through the turned-up end, for receiving separately each of the warp threads for a section of the warp beam. The server drastically reduces the labor and time of warping the loom; it also aids in duplicating threading from one warp section to another to repeat a warp pattern, and it also enables warp patterns changes to be made easily from section to section.

Three warp rods have capped rods mountable in the stanchion notches to place the warp rods across the stanchions. One capped end of each rod is removable to enable installation of warp spools thereon. With the spools placed on the warp rods and the rods set in place, the thread from each spool is led through the server during warping and from there is wound on the warp beam.

A novel beater reed comprises a rectangular frame with stub shafts projecting outwardly therefrom at the upper end for engagement in any pair of notches of the stanchions after the warp rods are removed therefrom. Its reed portion comprises spaced-apart bars to provide vertical thread-receiving slots therebetween, and each bar has a single central thread opening therethrough. The stub shafts normally support said beater reed vertically in any pair of stanchion notches, but they are also engageable with the upper surface of the forward portions of the support members for a nearly horizontal support of the reed during threading of warp threads through its openings and slots, and their tying to the tie-up bar. During weaving the beater reed is alternated between the upper notches and the lower notches, with the beating action used each time the position is changed.

Other features, advantages, and objects of the invention will appear from the following description of a preferred embodiment.

BRIEF DESCRIPTION OF THE DRAWINGS

In the drawings:

FIG. 7 is a view similar to FIG. 1 of the loom being set up for weaving.

FIG. 8 is a view in rear elevation of the loom with the parts in the position shown in FIG. 5.

FIG. 9 is an isometric view of a weaving shuttle with weft thread thereon.

FIG. 10 is a fragmentary isometric view of the upper portion on one side of the loom, with a design or finishing table installed, a portion of which is broken away and shown in section.

FIG. 11 is a fragmentary view in side elevation of the upper portion of the loom showing some of the warp from the warp beam attached to the tie-up bar of the cloth beam and extending through the beater reed, with the beater reed set in the central notches so that all warp threads lie in a common plane.

FIG. 12 is a view similar to FIG. 11 with the beater reed set in the lowest notches to produce a lower shed.

FIG. 13 is a view similar to FIGS. 11 and 12 with the beater reed set in the highest notches to produce an upper shed.

FIG. 14 is an exploded isometric view of one of the warp rods.

FIG. 15 is an exploded isometric view of the cloth beam with its tie-up bar attached by cord.

FIG. 16 is a fragmentary isometric view of portions of the cloth beam, the breast beam, and the tie-up bar with some warp threads secured thereto and with tension-tightening dowel rods inserted through the warp.

FIG. 17 is an enlarged view in end elevation of the sectional warp beam, with one rail shown in section.

FIG. 18 is an exploded isometric view of the sectional warp beam, broken in the middle.

FIG. 19 is a fragmentary enlarged view of a portion of the loom showing the pawl-ratchet engagement for the sectional warp beam.

FIG. 20 is a similar view with the pawl disengaged and in a rest position.

FIG. 21 is a fragmentary view in section of two frame members and the fastener member holding them together.

FIG. 22 is a fragmentary view in side elevation of the stanchions, with a swift installed on the accessory bar.

FIG. 23 is a fragmentary isometric enlarged view of a portion of the beater reed, with its upper frame member shown in phantom, to show the shape of one face of the beater reed.

FIG. 24 is a similar view looking at the other face of the beater reed.

FIG. 25 is a fragmentary view in side elevation showing the drawing board attachment held in a fully horizontal position.

FIG. 26 is a top plan view corresponding to FIG. 25.

FIG. 27 is a fragmentary view in side elevation of a modified form of retention system for the warp beam, in which the warp beam is removable.

FIG. 28 is a view in perspective of a tie-up bar, warp beam, beater reed, and warp with a portion of the weft completed, being removed as a unit from the loom.

DESCRIPTION OF A PREFERRED EMBODIMENT

Figure 1:
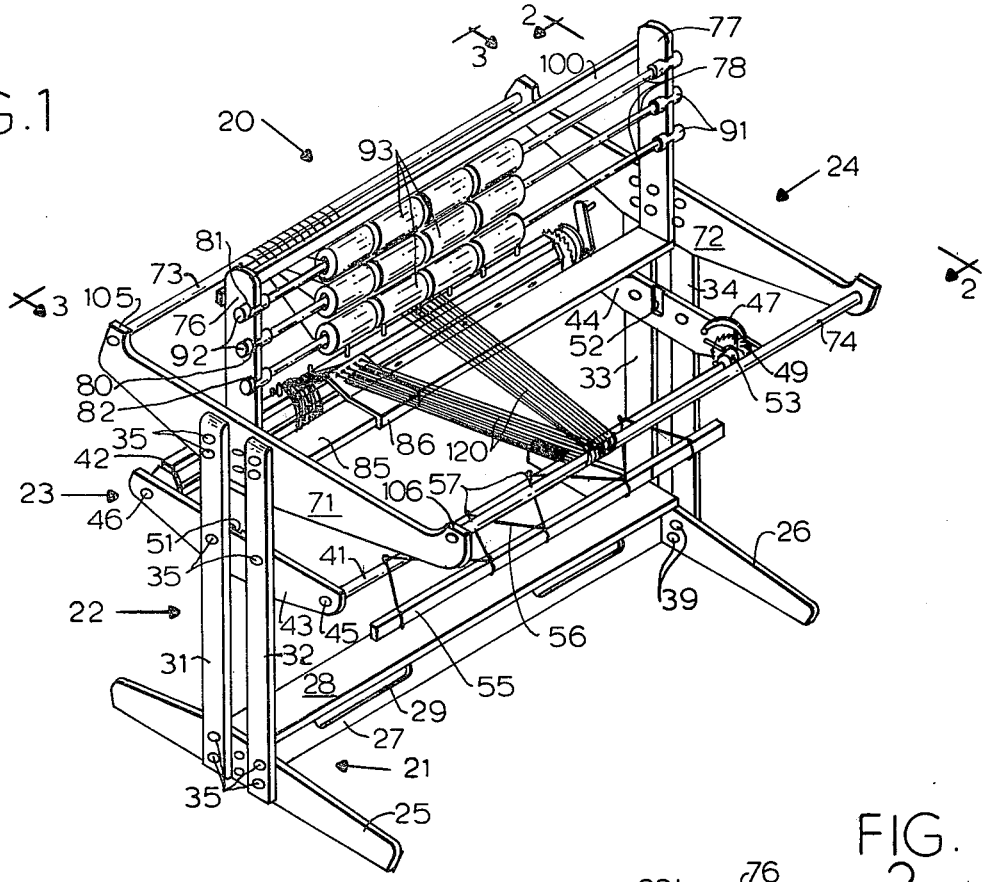
FIG. 1 is an isometric view of a loom embodying the principles of the invention, set up for placing the warp threads onto the sectional warp beam.

The drawings show a loom 20 embodying the principles of the invention. The loom 20 comprises a base assembly 21, a vertical support system 22, a mid-beam assembly 23, and a top-beam assembly 24. Each of these four basic assemblies is discussed in order.

The base assembly 21 (FIGS. 1 and 7)

A four-piece fixed base assembly 21 (FIGS. 1 and 7) has a general "I" shape, and its bottom surfaces engage and rest on the floor, preferably carpeted, to prevent sliding or walking either sideways or front-to-back. If the bottom surfaces are coated with non-sliding material, such as rubber, the base assembly 21 will not walk on smooth surfaces, such as wood, tile, or concrete. The base assembly 21 comprises two asymmetrically-shaped side feet 25 and 26 to provide balance and stability to working forces when the loom is in operation. As will be seen, the loom 20 extends more to the front than to the back; so the feet 25 and 26 extend further from the putative transverse centerline to the front than to the rear. Two transverse base members 27 and 28 extend between the feet 25 and 26. The base members 27 and 28 are arranged in a T shape—the bottom piece 27 is vertical and the upper piece 28 is horizontal—to provide structural stiffness and to prevent racking of the base assembly 21. The base assembly 21 may be locked together with screws and glue. The vertical bottom piece 27 may have cutouts 29 to prevent an over-heavy base appearance as well as to reduce the actual weight. The shapes of the cutouts 29 preferably repeat the visual theme of the overall design.

The vertical support system 22 (FIGS. 1 and 7, especially)

The vertical support system 22 of the loom 20 preferably comprises four vertical legs 31, 32, 33, and 34 secured to the feet 25 and 26 arranged two per side in a closely spaced, parallel position on each side of the working center plane of the loom 20. The legs provide the primary vertical structural support for the entire loom 20 as well as the main central connection element for the transversely positioned assemblies, i.e., the base assembly 21, the mid-beam assembly 23, and the top-beam assembly 24. Positioning the legs 31, 32, 33, and 34 approximately at an inward center plane provides as little as possible obstruction to the operations performed about the beams of the loom 20. Providing two legs per side (as opposed to one leg per side of equal width) reduces the overall weight of the loom 20 while achieving the same bolt spacing for the attached subassemblies, which helps to hold the loom 20 straight.

The legs 31, 32, 33, and 34 are connected to the feet 25 and 26 of the base assembly 21 and also to the other assemblies by fasteners 35, shown best in FIG. 21, each comprising a bolt 36, a nut 37, and a washer 38. These fasteners 35 enable ready disassembly of the fixed subassemblies as well as periodic tightening, adjustment, and alignment, when required. Preferably, the fasteners 35 are special; the bolts 36 have large (e.g., 1' diameter) flat heads used in conjunction with the washer 38 and nut 37 on a countersunk attachment side to provide large bearing surfaces that prevent pull-through under heavy clamping pressure. The countersunk hole is preferably plugged with a snap-in cover 39 simulating the exterior bolt head in appearance. The design characteristics developed by the large fastener bolt head preferably repeat the visual design found on the side view of the loom, where round front and back beams and beam shaft ends project through the bearing mounts. These along with the fastener heads are preferably painted black.

For maximum structural stiffness, with bracing front-to-back, a four-bolt pattern is used for attaching both the base and top assemblies 21 and 24. A two-bolt pattern is sufficient to attach the mid-beam assembly 23.

The mid-beam assembly 23 (FIGS. 1–3, 7, 8, and 11–13):

A mid-beam assembly 23 is comprised mainly of two rotating storage or operational beams 41 and 42 and two mid-beam supports 43 and 44. The cloth beam 41 and the sectional beam 42 rotate on stub shafts 45 and 46 which are mounted through the mid-beam support units 43 and 44. These units 43 and 44 support the entire subassembly 23 and are in turn bolted (as previously described) by fasteners 35 to the side legs 31, 32, 33, and 34 approximately midway between the top subassembly 24 and the base subassembly 21.

The mid-beam support units 43 and 44 are relatively short, so as to position both of the rotating beams 41 and 42 well inside the perimeter of the loom 20, thereby achieving compactness on the backside of the loom 20 and knee clearance for the cloth beam 41 on the front side. Along with providing bearing support for the two rotating beams 41 and 42, the mid-beam support units 43 and 44 provide a stable anchor on which pawls or dogs 47 and 48 are movably mounted for engagement, when desired, with ratchets 49 and 50, one of which is mounted on each beam 41 and 42. The pawl-ratchet combinations 47, 49, and 48, 50 provide brakes or stops for the two beams 41 and 42. Also, each mid-beam support unit 43, 44 is provided with a central notch or groove 51, 52 so as to develop a resting or storage slot (between them) for the warp rods 78 when they are not in use, as discussed below.

The cloth beam 41

The cloth beam 41 is a rotating storage beam. It is located at the front of the loom 20, just in front of the weavers' knees with its working rotation clockwise—a rotation opposite in direction to that of the sectional warp beam 42 which it tensions the warp threads against. The cloth beam 41 has two primary purposes: first, to take up the woven material as it is finished and roll it up in a stored position until the entire finished material is removed from the loom 20, and, second, to provide an adjustable tension to the warp by means of the ratchet 49 and a pawl 47 at one end, the ratchet 49 being mounted against a hub 53 with four handles 54. By using any one or more of the handles 54, the weaver can turn the beam 41 clockwise and can tighten the tension of the warp (as will be explained later). One "click" of the ratchet 49, a rotation of the ratchet 49 sufficient to lift the pawl 47 past the edge of one tooth of the ratchet 49 and to drop it behind the next tooth, corresponds to about 18° rotation of the beam 41. Counterclockwise rotation will loosen the tension by the same amount and can be achieved by lifting the pawl 47 out of engagement with the ratchet 49.

Attached to the cloth beam 41 at quarter points is a tie-up bar 55 (See FIG. 15). The primary purpose of the bar 55 is to provide a readily accessible attachment point for the weaver to tie the warp to. The bar 55 is connected to the beam 41 by a heavy continuous cord 56 which runs through several eyes 57 on the cloth beam 41 and consequently is self-adjusting to various warp tensions, should a change in tension occur. Preferably, the cord 56 is installed to space the tie-up bar 55 about twenty inches from the beam 41, when the tie-up bar 55 is extended to the maximum. Also, the tie-up bar 55 provides a continuous surface to attach the warp to in a variety of combinations. For example, the warp threads can be grouped in as many as twelve threads per tie (for a fast tie-up), or six threads (recommended) or as few as two, which results in slow weaving but, in turn, produces a fine, even, start-up of the woven piece.

The sectional warp beam 42

The sectional warp beam 42, first, stores the warp thread, and second, dispenses the warp thread through the loom 20 with even tension. The sectional warp beam 42 is located in the rear of the loom 20, opposite and parallel to the cloth beam 41, and is mounted to the mid-beam supports 43 and 44 by the stub shafts 46.

The sectional warp beam 42 (See FIG. 18) is relatively large in diameter as compared to the other beams on the loom 20 and is so constructed as to provide an easy, fast, method of measuring the warp thread as the loom 20 is warped, i.e., loaded. As shown in FIG. 17, the beam 42 is preferably comprised of four rails 60 running parallel to the transverse centerline of the beam 42. These rails 60 are mounted out from the center on end drums 61 which also provide mountings for the stub shafts 46 and the ratchet wheel 50. In between the end drums 61 are support blocks 62 (See FIG. 18). The rails 60 are divided into sections (hence the name, "sectional beam") by specially shaped dowel pins 63, one of which projects outwardly from each rail 60 at the end of each section to provide four dowel pins 63 circumferentially in line at each section. Thus, if there are twenty sections, there will be nineteen such groups of dowel pins 63 or seventy-six dowel pins 63. The dowel pins 63 have outer ends 64 that are both tapered and rounded to prevent any possibility of snagging the warp as it is put on the loom 20. Each section can be individually warped or loaded as opposed to warping the entire warp beam 42 at one time, and better control and more consistent tension is achieved. Also, lateral slipping of deeply stacked warp is eliminated, since the pins 63 provide sides for the warp to rest against—much like ends on a spool. These sections are designed to hold a regulated amount of warp thread, i.e., twelve threads per section. The sectional warp beam 42 is preferably built up in circumference to provide approximately ½ yard (18") per revolution. This becomes functional to measuring the amount of warp placed on the beam 42 for a weaving project: thus 2 revolutions=1 yard, 20 revolutions=10 yards, etc.

A handle 65 lies outside the perimeter plane of the loom and is secured to one of the end drums 61, as by a dowel 66. Preferably, this is the same drum 61 to which the ratchet wheel 50 is attached. The ratchet's pawl 48 (See FIGS. 19 and 20) is rotatably attached to the horizontal support member 44 and easy off-on positioning is provided by a unique rest pin 67, which (when the pawl 48 is swung out of engagement with the ratchet 50) rests on top of the support member 44. When the pawl 48 engages a tooth of the ratchet 50 and when there is tension on the beam 42, the beam 42 is restrained from rotation in the tension-increasing direction.

Another feature of the sectional warp beam 42 is the use of a warp extension cord 68 in the center of each section, i.e., midway between each group of dowels 63, this location helping to achieve even warp. For this purpose, one rail 60 is drilled through normal to the radial direction and in the exact center of each section to provide an opening 69. Each extension cord 68 has a knot at one end; the other end is inserted through the opening 69 and the knot then bears up against the rail 60. The warp extension cords 68 are long enough to go about once around the outside of the beam 42, and its outer end may be looped. For storage, the loop may be placed over one of the dowel pins 63. By securing each extension cord 68 through the rail 60, with the knot being on the side wall of that rail 60 rather than on the top, there is no knot in the way to cause uneven tension of warp. The warp extension cords 68 provide an economical method of saving warp, in that they provide an extension to the end of the warp and allow for its total usage as it extends up and over the back beam 42 to the beater reed 75. Without these extensions the warp would be cut off at the sectional warp beam 42—thus losing about 1 yard (×132 threads).

The top-beam assembly 24 (FIGS. 1–3, 7, 8, and 11–13):

The top-beam assembly 24 provides several important functions. It provides an horizontal working plane for the warp threads, provides a controlled system for separating the warp threads or for making a shed for control of woven pattern, provides vertical working positions for a beater reed when weaving and for warp rods when warping, and provides a total framework for the warp system, including racking spools, tensioning means for warp, and means for applying warp in predetermined numbers of threads onto the sectional beam. It also supports an accessory bar on which several attachments can be mounted.

The top-beam assembly 24 comprises two top-beam support members 71 and 72 which are secured to the legs 31, 32, 33, and 34 and are joined at their outer ends by two fixed, round beams 73 and 74, namely a back beam 73 and a breast beam 74. The stationary round beams 73 and 74 provide a horizontal plane on which to run the warp across and provide a smooth round surface over and around which the warp thread can be tensioned during the warping process without being cut or damaged.

The top-beam supports 71 and 72 which hold the beams 73 and 74 are bolted to the side legs 31, 32, 33, and 34 at an asymmetrical transverse "centerline," to provide more work space at the front of the loom 20 than at the back, so that the weaver can more easily see a large area of what has been woven, including the previous patterns, the colors, the yarns, and so on. Also, the supports 71 and 72 hold the beams 73 and 74 in such a position so as to align the upper surfaces of the beams 73 and 74 with openings through the center of a beater reed 75, when that is in its neutral position. Thus, the top support members 71 and 72 each have upturned ends 105, 106 that support the beams 73 and 74 on the same level, a level higher than the main upper surfaces of the members 71 and 72.

Figure 6:
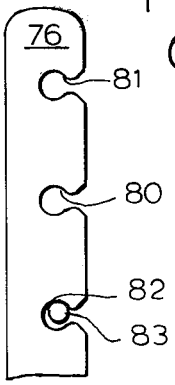
FIG. 6 is an enlarged view in side elevation of the upper portion of one of the stanchions of the loom, with a beater reed stub shaft shown in the lowest notch.

Notched stanchions 76 and 77 are secured to the top support members 71 and 72 and are used to position and support the beater reed 75 (FIGS. 7 and 8) at some times and, at other times, one or more warp rods 78 (See FIGS. 14 and 1–3). Each of the stanchions 76 and 77 has notches 80, 81 and 82 (See especially FIG. 6) so constructed to easily receive stub shafts 83 and 84 on the ends of the beater reed 75 without sliding out under heavy warp tension. The notches 80, 81 and 82 are so spaced as to balance and to match the required effort necessary to move the beater reed 75 either up or down from a neutral position, as will be explained below. The neutral position (notches 80) places the beater reed 75 in the center of the warp plane; moving the beater reed 75 up to an upper position at notches 81 or down to a lower position at notches 82 results in a nominal 3-inch shed being developed in alternate groups of warp thread. The center notch 80 may be 2¾ inches below the upper notch 81 and 3 inches above the lower notch 82.

Figure 4:
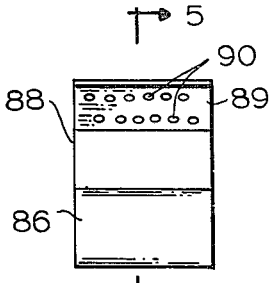
FIG. 4 is a top plan view of a novel server used in the loom during the operation illustrated in FIGS. 1-3.
Figure 5:
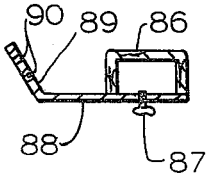
FIG. 5 is a view in section taken along the line 5—5 in FIG. 4.

The server 86 (FIGS. 4 and 5)

The lower ends of the notched stanchions 76 and 77 are joined by a single server rail 85 which is parallel to the sectional warp beam 42 and spans between the two top-beam supports 71 and 72. On this rail 85 rides a warp server 86. The server 86 clamps completely around the rail 85 and can be slid or positioned at any point along the rail 85, for the full width of the loom 20. The server 86 (See FIGS. 4 and 5) has a thumbscrew 87 tapped through the bottom which enables the server 86 to be locked at any desired point. The server 86 has its top and two sides preferably made of wood, while its lower face is a server arm 88, preferably metal, which projects out from the base of the server 86 and has a turned-up portion 89 at the end. This portion 89 is drilled to provide two alternately spaced or staggered rows of holes 90, preferably six holes 90 per row, so designed as to control the individual warp threads as they are fed as a group through the server 86 on to the sectional beam 42. This also enables a warp design or pattern to be repeated identically in each section of the sectional beam 42.

The warp rods 78 (FIG. 14)

Figure 2:
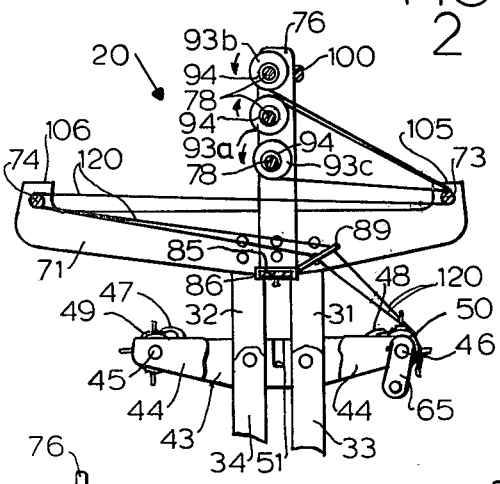
FIG. 2 is a fragmentary view in section of the upper portions of the loom taken along the line 2—2 in FIG. 1, with a portion of the mid-loom assembly broken away to show parts otherwise obscured.
Figure 3:
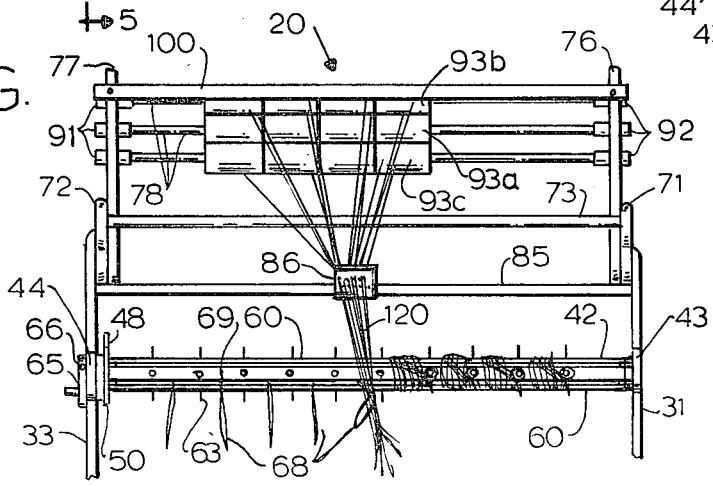
FIG. 3 is a fragmentary view in rear elevation of the same loom portions as in FIG. 2, viewed along the line 3—3 in FIG. 1.

In cooperation with the server 86, three warp rods 78 may be used in the loom 20. They are positioned in the notches 80, 81, and 82 in the notched stanchions 76 and 77 when the beater reed 75 is removed, as when the warp is being stored on the warp beam 42 (FIGS. 1–3). When not in use, the three rods 78 may be stored between the mid-beam supports 43 and 44 in the slotted storage grooves 51 and 52, as shown in FIGS. 11–13. Each rod 78 has two capped ends, one fixed end 91 and one removable end 92 (See FIG. 14) to allow installation of several spools 93 of warp on each rod 78. The rod diameter is smaller than the arbor 94 of each spool 93, so that each spool 93 can "free-wheel" during the warping process. The capped ends 91 and 92 of the rods 78 exactly or snugly fit in the notches 80, 81, and 82 and lock the rods 78 into position during the warping operation.

The beater reed 75 (FIGS. 7, 8, 11–13, 23, and 24):

The beater reed 75, when installed as shown in FIGS. 7 and 8, is located between the notched stanchions 76 and 77, perpendicular to the warp plane which runs between the back beam 73 and the breast beam 74. The warp is threaded through the beater reed 75 in alternate holes 95 and slots 96 (See also FIGS. 23 and 24). When the beater reed 75 rests in the neutral notch 80 (FIG. 11) all the warp threads are on one level. When the beater reed 75 is raised into the upper notch 81 (FIG. 13), the warp threads in the holes 95 are elevated, producing a "shed," while the alternate warp threads in the slots 96 remain in the same horizontal plane. Then when the beater reed 75 is lowered to the lower position in the notches 82 (FIG. 12), again the warp threads in the holes 95 are lowered producing a second, lower shed. This is the basic operation of the reed 75. The term "beater" refers to beating or nesting the weft yarn into place by moving the reed 75 along the warp threads toward the breast beam 74 so as to produce a constant weave appearance. The harder the material is beaten the tighter or denser the fabric.

The bearer reed 75 of this invention is unique in that it is reversible and offers two types of surfaces for beating, as shown in FIGS. 23 and 24. First, a flat surface 97 (See FIG. 23) on one side of the reed 75 between the holes 95 and the slots 96 produces only moderate pressure on the individual weft yarn because of its relatively broad surface, hence an open woven pattern. Second, by reversing the beater reed 75, i.e., turning the backside forward, a second pattern will be produced, because this side has sharp wedge edges 98 (See FIG. 24) between the slots 95 and holes 96 which pack the weft very closely, producing a dense, tightly woven fabric. Another feature of the beater reed 75 is that its stub shafts 83 and 84 are overlength, projecting out through the open ends of the notches 80, 81, or 82. This enables them to rest on the horizontal supports 71 and 72 during warping, with the reed 75 then substantially horizontal.

An accessory bar 100 is mounted to the backside of the notched stanchions 76 and 77, out of the operational way of warping and weaving on the loom but strategically placed so as to provide a surface on which to attach accessories which collectively make the entire unit a weaving system rather than just a loom.

Two important accessories are:

1. An umbrella yarn swift 101, as shown in FIG. 22, an extremely useful tool that holds yarn in skein form, allowing it to be removed by turning the unit 101 as required. The swift 101 is a conventional device; here it is mounted on the accessory bar 100 by means of a bracket 102 that is clamped by a thumbscrew 103 to hold it at any desired position along the accessory bar 100.

2. A drawing board or finishing table 110, as shown in FIG. 10, may be set between the accessory bar 100 and the breast beam 74. Alternatively, it may be placed flat as in FIGS. 25 and 26. The table 110 provides a drawing surface for designing and drawing woven work and also a work surface for finishing, detailing, and sewing the cloth. The table 110 has, on its lower surface either a continuous bracket or two short brackets 111 having a notch 112 that engages the accessory bar 100. The lower end of the table 110 rests on top of the breast beam 74 and preferably has a support lip 113. In flat position, the notch 112 rests on the breast beam 74, while a warp rod 78 in the lowest notches 82 supports the other end. The board 110 may then support a sewing machine, for example.

The operation of warping

1. Storing the warp threads

In warping, the loom is set up as shown in FIG. 1 with the warp rods 78 in place in the notches 80, 81, and 82. As shown typically, all three warp rods 78 are installed and where it is desired to use twelve threads per section, for example, four spools 93 of warping thread 120 are employed on each rod 78. The initial operation comprises getting the warp threads 120 onto the sectional warp beam 42. For this purpose, the three rods 78 are preferably set up as shown in FIGS. 2 and 3 so that the spools **93*a* on the center rod 78 rotate in an opposite direction from the spools 93*b* and 93*c* on the upper and lower rods 78, as shown best in FIG. 2. Then, even when the spools touch each other they are fed properly without interference. All twelve spools are partially unreeled, and the thread 120 brought over the top of the back beam 73 (See FIGS. 1 and 2) and then down around it, and, from the lower side thereof, brought forward and over the top of the breast beam 74. From there, the twelve threads 120 are brought back to the server 86. Each thread 120 is inserted through a separate opening 90 in the server 86, which preferably has two rows of six openings 90, with the rows staggered so that the twelve threads 120** each come out to a different horizontal position, evenly spaced apart.

The twelve threads 120 are then pulled through and a knot is made at their end, for example an overhand knot, tying all twelve threads 120 together. The server 86 is moved opposite to and in alignment with any selected section with warp beam 42. Then one of the warp extension cords 68 of the warp beam 42 is fastened to the knot, preferably by a slipknot on the cord 68. Then, any desired amount of warp thread may be reeled around the warp beam 42 in that one section thereof, in between two groups of dowel pins 63, by using the handle 65 to rotate the warp beam 42. When the desired amount of warp thread 120 for one section has been reeled onto the warp beam 42, the thread group is cut in between the server 86 and the warp beam 42, and another knot tied at the end of the cut-off group. Then the server 86 is moved along the rail 85 to a position opposite to and in alignment with the next section of the beam 42, a knot again being tied to hold the twelve threads together. Then the next warp extension cord 68 is fastened by a slipknot to that group of threads, and that group is reeled around the beam 42 in its section thereof. The operation continues until all the sections of the beam 42 to be used are fully provided with warp threads 120.

The important function of the server 86 is that only once do the threads have to be inserted through the openings 90 in the server 86. Once that is done, all of the sections of the sectional beam 42 can easily be provided with the same number of threads and the same length of threads, each group being knotted and tied by a slipknot to an extension cord 68. Of course, fewer threads 120 can be used if that is desired, and the server 86 can be made to accommodate more threads if that is desired.

The operation is continued until all sections of the sectional warp beam 42 are fully loaded with the warp thread 120. When the desired length of warp thread 120 is so reeled, the threads are cut off, pulled back through the server 86, put back on their spools, and the warp rods 78 and their spools 93, are removed from the loom 20. The spools 93 may be taken off the warp rods 78 and the warp rods 78 placed in the storage notches 51 and 52 (See FIGS. 11–13).

2. Setting up the warp on the loom

Next, the beater reed 75 is to be threaded. Rather than installing it vertically in one of the pairs of notches, it may at this time be place substantially horizontally with its stub shafts 83 and 84 resting on the upper surface of the support members 71 and 72 and closer to the breast beam 74 than is the other edge of the beater reed 75. This gives full visibility to a worker sitting in front of the breast beam 74.

The weaver then reaches through to the warping beam 42 and takes all the threads 120 of one section, preferably, pulling them first up over the accessory bar 100, and then down to about even with the breast beam 74, in order to allow enough length. This is solely for measurement purposes, and the threads 120 of all sections are arranged in this way. He may then lock the sectional warp beam 42 in place by setting the pawl 48 into engagement with the ratchet wheel 50. Then the threading into the beater reed 75 begins, preferably starting in the center of the loom, alternatively pulling a thread group back under the accessory bar 100 and threading the threads 120 for each section through the beater reed 75, so that one thread 120 goes through an opening 75, and the two threads 120 on either side of that go respectively into the slots 96 on each side of that opening 95 (See FIG. 7). The threading continues, with the slots 96 and openings 95 alternating and continuing out to each end. Each group of twelve threads, after being threaded through the beater reed 75, may then be tied to the tie-up bar 55 (See FIG. 16), which at that stage is brought up from the cloth beam 41 and looped up over the breast beam 74 so that it lies fairly close to the breast beam 74.

The operation continues with the weaver attempting to obtain even tension on the tie-up bar 55. This can be done readily by feel and observation, first doing one of the central sections of thread and then the ones at each end and then alternating the groups back-and-forth until all of them have been threaded through the beater reed 75 and joined to the tie-up bar 55. After that, the beater reed 75 is installed vertically (See FIG. 12), with its stub shafts 83 and 84 resting in the lowest pair of notches 82, and then with the pawl 47 set to engage the ratchet wheel 49, the handles 48 are used to tighten the tension on the warp to an amount just sufficient to lift the beater reed 75 so that its shafts 83 and 84 are carried up into contact with the upper edge of the notches 82. That gives a sufficient tension and can be judged to be about three clicks of the ratchet-pawl brake 47, 49. The evenness of the tension is checked, and the operation is ready for actual weaving.

The weaving operation

With the warp threads 120 all in place and the beater reed 75 in the lowest position (FIG. 12), the operation may begin.

First, shed sticks may be inserted near the ends of the threads 120 where they are tied to the tie-up bar 55. This may be done by using shed sticks 121 (FIG. 16), as by placing the beater reed 75 in the lowest notches 82, inserting one shed stick 121, moving the beater reed 75 to the upper notches 81, and inserting another shed stick 121. Two shed sticks 121 are usually sufficient but another one may be used if desired. Then the actual weaving begins.

Many different types of weaving techniques may be used, and there is no need to describe them all. A simple type of operation, by which a tabby weave is obtained, will therefore be described. yarn is previously put up onto hand shuttles 125 with different colored threads 126 or different sizes of threads on different shuttles 125, as desired by the weaver for his pattern. One end of a weft thread 126 on a shuttle 125 is placed slightly into the ends of the warp near the tie-up bar 55 for beginning the shuttle operation.

With the end of the thread in position and a sufficient additional length of thread unreeled from the shuttle 125, the shuttle 125 is passed through the shed 127 (FIG. 12) formed by the beater reed 75 preferably being in the lower pair of notches 82. In the shed 127, the threads **120*a* that go through the holes 95 are lower than the threads 120*b* that go through the notches 96. After the shuttle 125 has been passed through the shed 127, say from left to right, the beater reed 75 is removed from the lowest set of notches 81 and moved manually toward the weaver, combing the warp, and brought firmly up against the first pass of weft yarn 126, beating it up against the dowel rod 121. Then the beater reed 75 is raised and placed into the upper pair of notches 81, forming a shed 128 in which the warp threads 120*a* that pass through the holes 95 arre higher than the threads 120*b* that pass through the notches 96. Some weft yarn 126 is unreeled from the shuttle 125, and then the shuttle 125 is passed back through the shed 128 leaving a pass of weft thread 126 in that direction. Once again, the beater reed 75 is removed from the notches 81, used to beat the latest pass of weft thread and then placed in the lowest pair of notches 82. Thus, the weaving is carried out with alternating the beater reed 75 from the upper notches 81, passing yarn through the warp, to beating, to the lower notches 82**, passing weft yarn through, beating, and so on.

Of course, many different kinds of weaves can be done and different arrangements can be made, some using skips or double rows, finger-generated patterns, and so on. As the operation continues cloth is formed until the space between the cloth and the beater reed 75 in its shed-forming position becomes smaller and smaller. Then, the weaver eases the tension on the warp by releasing the pawl 47 from the ratchet wheel 49, then the weaver releases the pawl 48 from the ratchet wheel 50 and winds out some more warp from the warp beam 42. He then winds the cloth beam 41 to wind up some of the cord 56 around the beam 41, leaving the cloth end above the breast beam 74, with the tie-up bar 55 much closer to the cloth beam 41. He replaces both pawls 47 and 48 in their respective ratchets 49 and 50 and, placing the beater reed 75 in the lower notches 82 rotates the cloth beam 41 to give the desired tension, indicated by lifting the beater reed's stub shafts 83 and 84 up to the tops of the notches 82. Weaving recommences. Soon, the tie-up bar 55 will have to be wound around the cloth beam 41 and cloth wound around it. The operation continues until the warp has been fully used or a desired length of cloth woven, most of which will have been wound on the cloth beam 41. Then the warp is cut, and the woven cloth, which is then on the cloth beam 41, removed.

Removing a partially completed weaving project (FIGS. 27 and 28)

A modified form of the invention enables removal of a partially completed weaving project. For this purpose the mid-beam support units 43 and 44 hold the warp beam's stick shafts 46 so that they are supported in the bottom of a notch 130 in each unit; the notch 130 is open at the top. When the warp beam 42 is installed, it is held in the notches 130 by a pair of retaining pins 131, one of which extends across each notch 130 through bores 132 and 133, one on each side of the notch 130. Each pin 131 has a head 134, by which it can be removed or pushed into place.

To retain tension on the warp threads wound around the beam 42, a long strong rubber band may be placed lengthwise around the warp beam 42 and the warp thereon, or it may be tied with string. Preferably, however, a bar clamp 135 is used. This may be a wooden bar drilled to provide holes 136 of the same size and spacing as the projecting dowels 63 defining the sections of the sectional warp beam 42. In use, this bar clamp 135 is slipped over the dowels 63 of one bar 60, clamping the warp threads 120 between the members 135 and 60. The clamp 135 may then be held in place by a couple of rubber bands or a couple of string ties.

Suppose that the weaver wishes to remove a project before completing it. He releases the tie-up bar 55 from the cord 56 on the cloth beam 41 (unwinding the completed cloth from the cloth beam 41 if necessary), and removes the retaining pins 131. He can then lift the warp beam 42 out of the notches 130, carrying all the warp thereon with it, lift the beater reed 75 out of whatever notches it is in, and carry the whole assembly, as shown in FIG. 28, away, collapsing it for storage as desired. He may then put in a different warp beam 42, a different tie-up bar 55, and a different beater reed 75 and warp the loom with a different warp. Or the different warp beam 42 may be another partially completed project with its beater reed 75 and tie-up bar 55 joined to the warp beam 42 by warp and already having some cloth on it.

This structure enables the same loom 20 to be used by several individuals. For example, it may be in a classroom, where each weaver is a student using the loom 20 for one class period, and there may be several different weavers each using the loom 20 for a different project, one at each class period. Each project is easily removed and easily put back into place in a minute or less. Alternatively, a single weaver may, in this manner work for awhile on one project and change to another project quickly and easily.

To those skilled in the art to which this invention relates, many changes in construction and widely differing embodiments and applications of the invention will suggest themselves without departing from the spirit and scope of the invention. The disclosure and the description herein are purely illustrative and are not intended to be in any sense limiting.

We claim:

1. A weaving loom, including in combination:

a supporting base, a pair of upright support means secured to and extending up from said base, one on each side of the loom, a mid-beam subassembly, including horizontal support means secured to said upright support means on each side of the loom, a cloth beam extending between and rotatable relative to said horizontal support means on one side of said upright support means, and a sectional warp beam extending between and rotatable relative to said horizontal support means on the opposite side of said upright support means from said cloth beam, said cloth beam and said warp beam each having a ratchet brake means at one end, with a cooperating pawl for each brake means pivotally mounted to said horizontal support means, a top-beam subassembly, comprising generally horizontal upper support means secured to said upright support means, each having a forward portion and a back portion, the forward portion being considerably longer than said back portion, a stationary cylindrical breast beam extending across between the outboard ends of said forward portions, a stationary cylindrical back beam extending across between the outboard ends of said back portions, a pair of upright stanchions extending vertically up from said upper support means and having at least three vertically spaced-apart notches per stanchion to provide three horizontal notch levels, a server rail joining the lower ends of sid stanchions, a server slidably mounted along said server rail with clamp means for holding it at any desired position, said server having an outwardly projecting arm with an angularly turned-up end and having a plurality of staggered series of openings through said turned-up end for receiving separately all the warp threads to be used for each section of said warp beam, a plurality of warp rods, each removably mountable across said stanchions for resting in the pairs of notches, and a beater reed with stub shafts projecting outwardly from its upper end for engagement in any pair of said notches of the stanchions, and having a reed portion of spaced-apart bar portions to provide slots therebetween, each bar having a central opening therethrough.

2. The loom of claim 1 wherein the stub shafts of said beater reed extend out far enough so that they can also support the beater reed by resting on the upper surface of said forward portions for a nearly horizontal support of said reed during threading of warp threads through its opening and slots.

3. The loom of claim 1 having a tie-up bar and cord means connecting the tie-up bar flexibly to said cloth beam.

4. The loom of claim 1 having an accessory bar joining said stanchion near its upper end on the side facing said back beam.

5. The loom of claim 4 having a drawing board with a pair of notched members projecting out from its lower surface for engagement with said accessory bar and a length sufficient then to rest its other edge on said breast beam.

6. The loom of claim 4 having a swift with an upright supporting shaft and a bracket slidably and removably mounted on said accessory bar and means for tightly clamping said bracket to said accessory bar.

7. A weaving loom, including in combination:

a supporting base, a pair of upright support means secured to and extending up from said base one on each side of the loom, a mid-beam subassembly, including horizontal support means secured to said upright support means on each side of the loom, a cloth beam extending between and rotatable relative to said horizontal support means on one side of said upright support means, a sectional warp beam extending between and rotatable relative to said horizontal support means on the opposite side of said upright support means from said cloth beam, and brake means for each said rotatable beam, a top-beam subassembly, comprising generally horizontal upper support means secured to said upright support means, each having a forward portion and a back portion, a stationary cylindrical breast beam extending across between the outboard ends of said forward portions, a stationary cylindrical back beam extending across between the outboard ends of said back portions, a pair of upright stanchions extending vertically up from said upper support means and having at least three vertically spaced-apart notches per stanchion on the same horizontal level with those of the other stanchion, at least one warp rod mountable across said stanchions in their notches, and a beater reed having stub shafts projecting outwardly therefrom at the upper end for engagement in any pair of said notches of the stanchions, and having a reed portion with spaced-apart bars to provide slots therebetween, each bar having a central opening therethrough.

8. The loom of claim 7 having a server rail joining said stanchions, and a server slidably mounted along said server rail with clamp means for holding it at any desired position thereon, said server having an outwardly projecting arm with an angularly turned-up end and having a plurality of staggered series of openings through said turned-up end for receiving separately all the warp threads for each section of said warp beam.

9. The loom of claim 7 wherein said beater reed's stub shafts extend out far enough to span the upper surface of said forward portions for nearly horizontal support of said reed during threading of warp threads through its opening and slots.

10. The loom of claim 7 wherein said beater reed is reversible, one side having flat coplanar bar surfaces, the other side having each bar provided with an angularly-extending vertex portion below each slot and each hole, for a different kind of beating.

11. A weaving loom, including in combination:

a supporting base, a pair of upright support means secured to and extending up from said base one on each side of the loom, a mid-beam subassembly, including horizontal support means secured to said upright support means on each side of the loom, a cloth beam extending between and rotatable relative to said horizontal support means on one side of said upright support means, a sectional warp beam extending between and rotatable relative to said horizontal support means on the opposite side of said upright support means from said cloth beam, a top-beam subassembly, comprising generally horizontal upper support means secured to said upright support means, each having a forward portion and a back portion, a stationary cylindrical breast beam extending across between the outboard ends of said forward portions, a stationary cylindrical back beam extending across between the outboard ends of said back portions, a pair of upright stanchions extending vertically up from said upper support means and having at least three vertically spaced-apart notches per stanchion on the same horizontal level with those of the other stanchion, a server rail joining the lower ends of said stanchions, a server slidably mounted along said server rail with clamp means for holding it at any desired position thereon, said server having an outwardly projecting arm with an angularly turned-up end and having a staggered plurality of series of openings through said turned-up end for receiving separately all the warp threads for each section of said warp beam, and a plurality of warp rods, each mountable across said stanchions for resting in the pairs of notches.

12. The loom of claim 11 wherein said sectional warp beam comprises two end drums providing four flat surfaces, four rails joining said end drums, each rail resting on one said flat surface of each drum, intermediate rail support means in between said drums, a stub shaft extending out from each drum, a series of dowel rods secured to and projecting out radially from each rail aligned to provide a series of circumferential series with a section between each adjacent pair of dowel rods, one said rail having a bore therethrough in each section perpendicular in direction to the direction of its said dowel rod, each bore being midway between each two adjacent dowel rods, and a cord for each section extending through each said rail and retained at one side thereof.

13. The loom of claim 12 having a ratchet wheel at one end secured to a said end drum, and a pivoted pawl mounted on a said mid-beam horizontal support means for engagement with said ratchet wheel in one position.

14. The loom of claim 13 wherein said pawl has a rest pin projecting from one side for engagement with its horizontal support means when swung out of engagement with said ratchet.

15. The loom of claim 13 having a handle secured to said drum for winding said warp beam.

16. The loom of claim 12 wherein the outer ends of each said dowel rod are tapered and rounded.

17. A weaving loom, including in combination:

a pair of base feet, an on-edge connecting transverse member extending between and joining said feet, a horizontal connecting transverse member extending between and joining said feet and resting on and secured to the upper edge of said on-edge member, two pairs of vertical upright members secured to and extending up from the outer surface of said base feet, one pair for each said foot, said pair being spaced apart from each other and parallel to each other, each connected to said base feet by a plurality of bolts, two mid-beam horizontal support members, one secured to each pair of vertical upright members by bolts, a cloth beam supported rotatably by said mid-beam support members on one side of said upright member, a warp beam supported rotatably by said beam support members to the other side of said upright members, two top-beam horizontal support members, one secured to each pair of vertical upright members by at least two bolts each, a stationary back beam supported by the top-beam support members on the same side of said upright members on said warp beam, a stationary breast beam supported by the top-beam support members on the other side of said upright members, a pair of upright stanchions extending up from said top-beam support members each in line with the space between said upright members, said stanchions having means for removably supporting warp rods and a beater reed.

18. The loom of claim 17 wherein the lower edges of said feet and said on-edge transverse member are coplanar, to provide a walk-preventing base surface.

19. The loom of claim 18 wherein said lower edges are rubberized.

20. The loom of claim 17 wherein said top support members extend further out on their breast-beam side than on their back-beam side, to give a large weaving space on the breast-beam side, and said feet also extend out further on the breast-beam side than on the back-beam side to give added stability.

21. The loom of claim 20 where the mid-beam support members are shorter than the top-beam support members and are shorter than the feet, with the cloth beam and warp beam being located much closer together than are the breast beam and back beam.

22. The loom of claim 20 wherein the top-beam support member has a main, generally horizontal surface and has upturned end portions for support of the breast beam and back beam on the same level higher than the upper surface of said main portion.

23. The loom of claim 17 wherein said means for rotatably supporting comprises a series of notches in said stanchion facing said breast beam, each notch having a main circular portion with an entry smaller than the diameter of the circle.

24. The loom of claim 23 wherein said stanchions are joined adjacent their lower ends by a transverse horizontal bar and are joined adjacent their upper ends by a transverse bar secured to the sides of the stanchions opposite their notched sides.

25. A weaving loom, including in combination:

a supporting base, a spaced-apart pair of uprights secured to and extending up from said base on each side of the loom, a mid-beam subassembly, including a pair of generally horizontal support members, one secured to each pair of uprights, each having a fore portion and a rear portion, a cloth beam extending between and rotatable relative to said fore portions, and a sectional warp beam extending between and rotatable relative to said rear portions, said cloth beam having a tie-up bar connected to said cloth beam by cord, said cloth beam having a first ratchet wheel at one end and a first pawl pivotally mounted to a said fore portion adjacent that end for engagement with said ratchet wheel, and handle means adjacent said ratchet wheel for rotating said cloth beam, said sectional warp beam comprising a series of rails having section-defining dowels therealong to define sections thereon, a cord for each between-dowel section anchored to and extending through one said rail, a second ratchet wheel at one end, and a second pawl pivoted to one said rear portion adjacent said ratchet wheel for engagement therewith, and handle means for rotating said warp beam, a top-beam subassembly, comprising a pair of generally horizontal support members, one secured to each pair of uprights and comprising a forward portion and a back portion, the forward portion being longer than said back portion, a stationary cylindrical breast beam extending across between the outboard ends of said forward portions, a stationary cylindrical back beam extending across between the outboard ends of said back portions, a pair of upright stanchions extending vertically up from the support members of the top-beam subassembly and having at least three vertically spaced-apart notches per stanchion on the same horizontal level with those of the other stanchion, a server rail joining the lower ends of said stanchions, and an accessory bar joining said stanchions near their upper ends, a server slidably mounted along said server rail with clamp means for holding it at any desired position, said server having an outwardly projecting arm with an angularly turned-up end and having a series of openings through said turned-up end for receiving separately all the warp threads for one section of said warp beam, at least three warp rods, each mountable across said stanchions and then resting in the pairs of notches, said warp rods each having one removable end for installation of warp spools thereon, and a beater reed comprising a rectangular frame with stub shafts projecting outwardly therefrom at the upper end for engagement to any pair of said notches of the stanchions, and having a reed portion of spaced-apart bars to provide slots therebetween, each bar having a central opening therethrough, said stub shafts normally supporting said beater reed vertically in any pair of said notches and also engageable with the upper surface of said forward portions for a nearly horizontal support of said reed during threading of warp threads through its opening and slots.

26. The loom of claim 5 wherein said drawing board's notched members can rest on said breast beam and on one said warp rod inserted in the lowest notch level of said stanchion, said lowest notch level and said breast beam being so located that said drawing board is then horizontal.

27. A weaving loom, including in combination:

a supporting base, a pair of upright support means secured to and extending up from said base one on each side of the loom, a mid-beam subassembly, including horizontal support means secured to said upright support means on each side of the loom, a cloth beam extending between and rotatable relative to said horizontal support means on one side of said upright support means, a sectional warp beam extending between and rotatable relative to said horizontal support means on the opposite side of said upright support means from said cloth beam, said horizontal support means supporting said warp beam in open-end vertical notches, with a removable retaining pin normally closing each notch, so that said warp beam is freely removable upon withdrawal of said retaining pins, and brake means for each said rotatable beam, a tie-up bar attached for ready removal to said cloth beam, a top-beam subassembly, comprising generally horizontal upper support means secured to said upright support means, each having a forward portion and a back portion, a stationary cylindrical breast beam extending across between the outboard ends of said forward portions, a stationary cylindrical back beam extending across between the outboard ends of said back portions, a pair of upright stanchions extending vertically up from said upper support means and having at least three vertically spaced-apart notches per stanchion on the same horizontal level with those of the other stanchion, and a beater reed having stub shafts projecting outwardly therefrom at the upper end for engagement in any pair of said notches of the stanchions, and having a reed portion with spaced-apart bars to provide slots therebetween, each bar having a central opening therethrough, whereby the warp during weaving passes from said warp beam through said beater rod and is secured to said tie-up bar, so that a weaving project may be removed intact before completion and later put back on the loom, by detaching said tie-up bar, said beater reed, and said warp beam from said board.

28. A weaving loom, including in combination:

a supporting base, a pair of upright support means secured to and extending up from said base, one on each side of the loom, a mid-beam subassembly, including horizontal support means secured to said upright support means on each side of the loom, a cloth beam extending between and rotatable relative to said horizontal support means on one side of said upright support means, and a sectional warp beam extending between and rotatable relative to said horizontal support means on the opposite side of said upright support means from said cloth beam, means for quickly releasing said warp beam from said mid-beam subassembly, a tie-up bar, means for attaching said tie-up bar to said cloth beam while enabling its ready removal therefrom, a top-beam subassembly, comprising generally horizontal upper support means secured to said upright support means, each having a forward portion and a back portion, the forward portion being considerably longer than said back portion, a stationary cylindrical breast beam extending across between the outboard ends of said forward portions, a stationary cylindrical back beam extending across between the outboard ends of said back portions, a pair of upright stanchions extending vertically up from said upper support means and having at least three vertically spaced-apart notches per stanchion to provide three horizontal notch levels, and a beater reed with stub shafts projecting outwardly from its upper end for engagement in and immediate removal at any time from any pair of said notches of the stanchions, and having a reed portion of spaced-apart bar portions to provide slots therebetween, each bar having a central opening therethrough.

* * * * *